US010082322B2

(12) United States Patent
Ito et al.

(10) Patent No.: US 10,082,322 B2
(45) **Date of Patent: *Sep. 25, 2018**

(54) HEAT EXCHANGER AND AIR-CONDITIONING APPARATUS

(71) Applicant: Mitsubishi Electric Corporation, Tokyo (JP)

(72) Inventors: Daisuke Ito, Tokyo (JP); Shin Nakamura, Tokyo (JP); Shinya Higashiiue, Tokyo (JP); Shigeyoshi Matsui, Tokyo (JP); Akira Ishibashi, Tokyo (JP); Yuki Ugajin, Tokyo (JP); Takumi Nishiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/503,483

(22) PCT Filed: Oct. 7, 2014

(86) PCT No.: PCT/JP2014/076802
§ 371 (c)(1),
(2) Date: Feb. 13, 2017

(87) PCT Pub. No.: WO2016/056064
PCT Pub. Date: Apr. 14, 2016

(65) Prior Publication Data

US 2017/0241684 A1 Aug. 24, 2017

(51) Int. Cl.
*F28F 9/26* (2006.01)
*F25B 39/00* (2006.01)
(Continued)

(52) U.S. Cl.
CPC ..... *F25B 39/00* (2013.01); *F25B 13/00* (2013.01); *F28F 9/0243* (2013.01);
(Continued)

(58) Field of Classification Search
CPC ..... F25B 39/00; F25B 13/00; F25B 39/028; F25B 2500/08; F28F 9/0243; F28F 9/0275; F28F 9/0278
(Continued)

(56) References Cited

U.S. PATENT DOCUMENTS

2013/0240186 A1 9/2013 Taras et al.
2014/0224461 A1 8/2014 Bellenfant et al.
2017/0241683 A1* 8/2017 Ito ..... F25B 39/00

FOREIGN PATENT DOCUMENTS

CN 103270386 A 8/2013
JP 04-187991 A 7/1992
(Continued)

OTHER PUBLICATIONS

Diasuke Ito, U.S. Appl. No. 15/503,460 (US 2017/0241683), Feb. 13, 2017, entire document.*
(Continued)

*Primary Examiner* — Davis Hwu
(74) *Attorney, Agent, or Firm* — Posz Law Group, PLC

(57) ABSTRACT

A heat exchanger, in which refrigerant causing disproportionation is used, includes a main heat exchange unit including a plurality of first heat transfer pipes arranged side by side, a sub-heat exchange unit including a plurality of second heat transfer pipes arranged side by side, and a relay unit including a plurality of relay passages connecting the plurality of first heat transfer pipes and the plurality of second heat transfer pipes. Each of the plurality of relay passages has one inlet connected to a corresponding one of the plurality of second heat transfer pipes, and a plurality of outlets each connected to a corresponding one of the plurality of first heat transfer pipes. Each of the plurality of relay passages distributes the refrigerant flowing from the one inlet, without merging streams of the refrigerant
(Continued)

together, and causes the refrigerant to flow out of the plurality of outlets.

8 Claims, 7 Drawing Sheets

(51) Int. Cl.
*F28F 9/02* (2006.01)
*F25B 13/00* (2006.01)
*F25B 39/02* (2006.01)

(52) U.S. Cl.
CPC ..... *F28F 9/0275* (2013.01); *F28F 9/0278* (2013.01); *F25B 39/028* (2013.01); *F25B 2500/08* (2013.01)

(58) Field of Classification Search
USPC ..... 165/143
See application file for complete search history.

(56) References Cited

FOREIGN PATENT DOCUMENTS

| | | | |
|---|---|---|---|
| JP | 06-011291 | A | 1/1994 |
| JP | 09-189463 | A | 7/1997 |
| JP | 2008-261552 | A | 10/2008 |
| JP | 2009-270781 | A | 11/2009 |
| JP | 2010-236707 | A | 10/2010 |
| JP | 2012-052676 | A | 3/2012 |
| JP | 2012-163328 | A | 8/2012 |
| JP | 2013-083419 | A | 5/2013 |
| JP | 2013-155961 | A | 8/2013 |
| JP | 2014-031944 | A | 2/2014 |
| JP | 2014-518370 | A | 7/2014 |
| WO | 2013/161799 | A1 | 10/2013 |
| WO | 2014/156743 | A1 | 10/2014 |

OTHER PUBLICATIONS

Office Action dated Oct. 31, 2017 issued in corresponding JP patent application No. 2016-552735 (and English translation).
International Search Report of the International Searching Authority dated Jan. 6, 2015 for the corresponding International application No. PCT/JP2014/076802 (and English translation).
Communication pursuant to Article 164(1) EPC dated May 23, 2018 for the corresponding EP application No. 14903604.8.
Chinese Office Action dated May 25, 2018 for the corresponding CN application No. 201480082380.6 (with English translation).

* cited by examiner

HEAT EXCHANGER AND AIR-CONDITIONING APPARATUS

CROSS REFERENCE TO RELATED APPLICATION

This application is a U.S. national stage application of PCT/JP2014/076802 filed on Oct. 7, 2014, the contents of which are incorporated herein by reference.

TECHNICAL FIELD

The present invention relates to a heat exchanger including a main heat exchange unit and a sub-heat exchange unit, and to an air-conditioning apparatus including the heat exchanger.

BACKGROUND ART

In a refrigeration cycle apparatus, such as an air-conditioning apparatus, when refrigerant is changed from R410A refrigerant, R4070 refrigerant, and other HFC mixed refrigerants having a lower boiling point than R134a refrigerant to R1234yf refrigerant, a need arises to increase a circulation amount of the refrigerant due to a low operating pressure of R1234yf refrigerant. As a result, a flow rate of the refrigerant flowing through a refrigerant circuit is increased to lead to an increase in pressure loss of the refrigerant and a reduction in operation efficiency of the refrigeration cycle apparatus. To address this problem, the refrigerant has been considered to be changed from R410A refrigerant, R4070 refrigerant, and other HFC mixed refrigerants to refrigerant having a property of causing disproportionation, such as R1123 refrigerant and a mixed refrigerant containing R1123 refrigerant. The refrigerant having the property of causing the disproportionation, such as R1123 refrigerant and the mixed refrigerant containing R1123 refrigerant, has a GWP equivalent to that of R1234yf refrigerant, and a higher operating pressure than R1234yf refrigerant. Consequently, in a case where the refrigerant is changed to the refrigerant having the property of causing the disproportionation, such as R1123 refrigerant and the mixed refrigerant containing R1123 refrigerant, the operation efficiency of the refrigeration cycle apparatus is enhanced to be higher than that of a case where the refrigerant is changed to R1234yf refrigerant.

Meanwhile, a related-art heat exchanger includes a main heat exchange unit including a plurality of first heat transfer pipes arranged side by side, a sub-heat exchange unit including a plurality of second heat transfer pipes arranged side by side, and a relay unit including a plurality of relay passages connecting the plurality of first heat transfer pipes and the plurality of second heat transfer pipes. The relay passages have inlets connected to the second heat transfer pipes, and outlets connected to the first heat transfer pipes. When the heat exchanger acts as an evaporator, refrigerant flows into the first heat transfer pipes from the second heat transfer pipes through the relay passages. When the heat exchanger acts as a condenser, the refrigerant flows into the second heat transfer pipes from the first heat transfer pipes through the relay passages (for example, see Patent Literature 1).

CITATION LIST

Patent Literature

Patent Literature 1: Japanese Unexamined Patent Application Publication No. 2013-83419 (paragraph [0039] to paragraph [0052], and FIG. 2)

SUMMARY OF INVENTION

Technical Problem

In the related-art heat exchanger, the relay passages have a plurality of inlets connected to the second heat transfer pipes, and a plurality of outlets connected to the first heat transfer pipes. Consequently, when the heat exchanger acts as an evaporator, streams of the refrigerant flowing into the relay passages from the plurality of second heat transfer pipes are once merged together, and then distributed to the plurality of first heat transfer pipes, with the result that a pressure loss of the refrigerant passing through the relay unit is increased. Consequently, in a refrigeration cycle apparatus, such as an air-conditioning apparatus, including the heat exchanger as described above, when the refrigerant is changed to refrigerant having a property of causing disproportionation, such as R1123 refrigerant and a mixed refrigerant containing R1123 refrigerant, the refrigerant has a high temperature and a high pressure, and is liable to cause the disproportionation. Further, due to low chemical stability of the refrigerant having the property of causing the disproportionation, such as R1123 refrigerant and the mixed refrigerant containing R1123 refrigerant, decomposition and bonding with other substances are facilitated in a refrigerant circuit to produce sludge, and the passages become more liable to be occluded. In other words, no technology is established of applying, to the heat exchanger including the main heat exchange unit and the sub-heat exchange unit, the refrigerant having the property of causing the disproportionation, such as R1123 refrigerant and the mixed refrigerant containing R1123 refrigerant.

The present invention has been made in view of the problem as described above, and therefore has an object to provide a heat exchanger, to which refrigerant having a property of causing disproportionation, such as 81123 refrigerant and a mixed refrigerant containing R1123 refrigerant, can be applied. Further, the present invention has an object to provide an air-conditioning apparatus including the heat exchanger as described above.

Solution to Problem

A heat exchanger according to one embodiment of the present invention, in which refrigerant causing disproportionation is used, includes a main heat exchange unit including a plurality of first heat transfer pipes arranged side by side, a sub-heat exchange unit including a plurality of second heat transfer pipes arranged side by side, and a relay unit including a plurality of relay passages connecting the plurality of first heat transfer pipes and the plurality of second heat transfer pipes. Each of the plurality of relay passages has one inlet connected to a corresponding one of the plurality of second heat transfer pipes, and a plurality of outlets each connected to a corresponding one of the plurality of first heat transfer pipes. Each of the plurality of relay passages distributes the refrigerant flowing from the one inlet, without merging streams of the refrigerant together, and causes the refrigerant to flow out of the plurality of outlets.

Advantageous Effects of Invention

In the heat exchanger according to the one embodiment of the present invention, each of the relay passages has one inlet connected to the corresponding one of the second heat transfer pipes, and a plurality of outlets each connected to a corresponding one of the plurality of first heat transfer pipes, and distributes, when the heat exchanger acts as an evaporator, the refrigerant flowing from the one inlet, without merging the streams of the refrigerant together, and causes the refrigerant to flow out of the plurality of outlets, with the result that the pressure loss of the refrigerant passing through the relay unit is reduced. Consequently, in a refrigeration cycle apparatus, such as an air-conditioning apparatus, including the heat exchanger as described above, when the refrigerant is changed to the refrigerant having the property of causing the disproportionation, such as R1123 refrigerant and the mixed refrigerant containing R1123 refrigerant, the operation efficiency is enhanced to reduce a discharge temperature so that the refrigerant is prevented from causing the disproportionation. Further, the number of relay passages is smaller than the number of paths in the main heat exchange unit and the sub-heat exchange unit, and hence the occlusion that occurs in the relay passages significantly contributes to a reduction in performance of the heat exchanger. Consequently, the production of the sludge, that is, the occlusion is suppressed in the relay passages to effectively suppress the reduction in performance of the heat exchanger.

DESCRIPTION OF EMBODIMENTS

Figure 1:
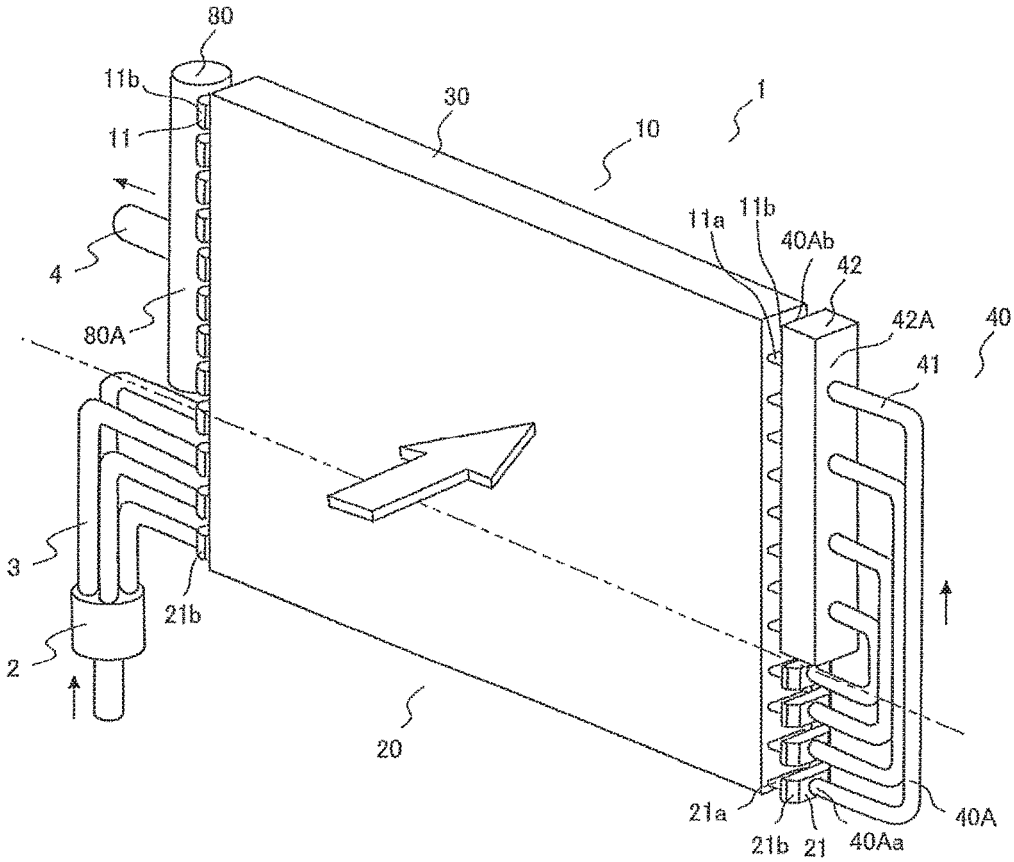
FIG. 1 is a perspective view of a heat exchanger according to Embodiment 1 of the present invention.

A heat exchanger according to the present invention is described below with reference to the drawings.

The configuration, operation, and other matters described below are merely examples, and the heat exchanger according to the present invention is not limited to such a configuration, operation, and other matters. Further, in the drawings, the same or similar components may be denoted by the same reference signs, or the reference signs for the same or similar components may be omitted. Further, the illustration of details in the structure is appropriately simplified or omitted. Further, overlapping description or similar description is appropriately simplified or omitted.

Further, a following case is described where the heat exchanger according to the present invention is applied to an air-conditioning apparatus, but the present invention is not limited to such a case, and for example, the heat exchanger according to the present invention may be applied to other refrigeration cycle apparatus including a refrigerant circuit. Still further, a following case is described where the air-conditioning apparatus switches between a heating operation and a cooling operation, but the present invention is not limited to such a case, and the air-conditioning apparatus may perform only the heating operation or the cooling operation.

Embodiment 1

A heat exchanger according to Embodiment 1 of the present invention is described.

<Outline of Heat Exchanger>

Figure 2:
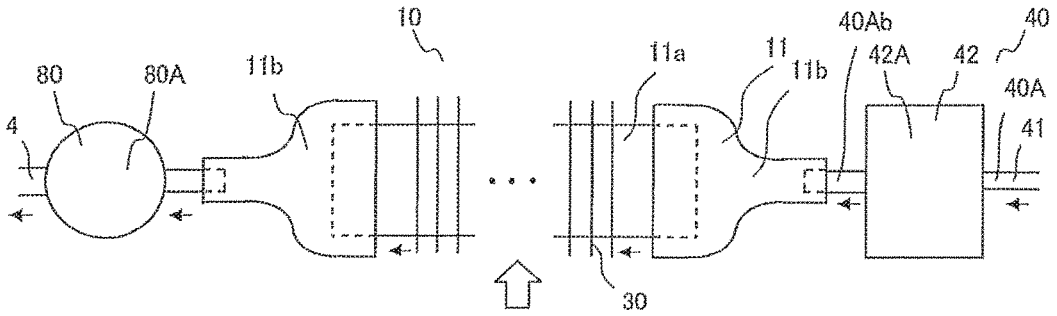
FIG. 2 is a top view of a main heat exchange unit and a part of a relay unit of the heat exchanger according to Embodiment 1.
Figure 3:
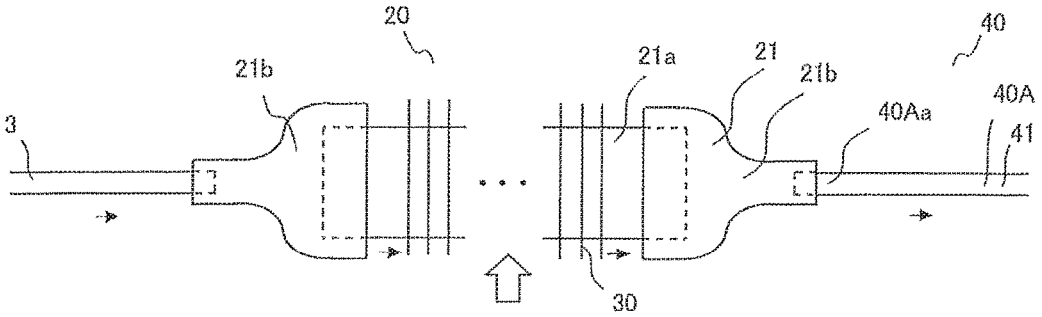
FIG. 3 is a top view of a sub-heat exchange unit and a part of the relay unit of the heat exchanger according to Embodiment 1.

FIG. 1 is a perspective view of the heat exchanger according to Embodiment 1. FIG. 2 is a top view of a main heat exchange unit and a part of a relay unit of the heat exchanger according to Embodiment 1. FIG. 3 is a top view of a sub-heat exchange unit and a part of the relay unit of the heat exchanger according to Embodiment 1. In FIG. 1 to FIG. 3, a flow of refrigerant when a heat exchanger 1 acts as an evaporator is indicated by the black arrows. Further, in FIG. 1 to FIG. 3, a flow of air for exchanging heat with the refrigerant in the heat exchanger 1 is indicated by the white arrow.

As illustrated in FIG. 1 to FIG. 3, the heat exchanger 1 includes a main heat exchange unit 10 and a sub-heat exchange unit 20. The sub-heat exchange unit 20 is located below the main heat exchange unit 10 in the gravity direction. The main heat exchange unit 10 includes a plurality of first heat transfer pipes 11 arranged side by side, and the sub-heat exchange unit 20 includes a plurality of second heat transfer pipes 21 arranged side by side. Each of the first heat transfer pipes 11 includes a flat pipe 11*a*, in which a plurality of passages are formed, and joint pipes 11*b* attached to both ends of the flat pipe 11*a*. Each of the second heat transfer pipes 21 includes a flat pipe 21*a*, in which a plurality of passages are formed, and joint pipes 21*b* attached to both ends of the flat pipe 21*a*. Each of the joint pipes 11*b* has a function of combining the plurality of passages formed in a corresponding one of the flat pipes 11*a* into one passage, and each of the joint pipes 21*b* has a function of combining the plurality of passages formed in a corresponding one of the flat pipes 21*a* into one passage. When each of the flat pipe 11*a* and the flat pipe 21*a* is a circular pipe, in which one passage is formed, the first heat transfer pipes 11 and the second heat transfer pipes 21 do not include the joint pipes 11*b* and the joint pipes 21*b*, respectively.

Fins 30 are joined by, for example, brazing to each extend across the plurality of first heat transfer pipes 11 and the plurality of second heat transfer pipes 21. The fins 30 may be divided into a part extending across the plurality of first heat transfer pipes 11 and a part extending across the plurality of second heat transfer pipes 21.

The plurality of first heat transfer pipes 11 and the plurality of second heat transfer pipes 21 are connected to each other by a plurality of relay passages 40A formed in a relay unit 40. The relay unit 40 includes a plurality of pipes 41, and a stacking type header 42 including a plurality of branch passages 42A formed in the stacking type header 42. Each of the plurality of pipes 41 has one end connected to a corresponding one of the plurality of branch passages 42A to form each of the plurality of relay passages 40A. In other words, each of the relay passages 40A is formed of one of the pipes 41 and one of the branch passages 42A formed inside the stacking type header 42, with an inlet of the one of the pipes 41 serving as an inlet 40Aa of the relay passage 40A, and with an outlet of the one of the branch passages 42A serving as an outlet 40Ab of the relay passage 40A. Each of the pipes 41 has an other end connected to a corresponding one of the second heat transfer pipes 21. Each of the first heat transfer pipes 11 has one end connected to the outlet of a corresponding one of the branch passages 42A, and an other end connected to a tubular header 80. A merging passage 80A is formed inside the tubular header 80.

When the heat exchanger 1 acts as the evaporator, the refrigerant branched by a distributor 2 passes through pipes 3 to flow into the second heat transfer pipes 21. The refrigerant passing through the second heat transfer pipes 21 passes through the pipes 41 to flow into the branch passages 42A. The refrigerant flowing into the branch passages 42A is branched to flow into the plurality of first heat transfer pipes 11, and then into the merging passage 80A. Streams of the refrigerant flowing into the merging passage 80A are merged together to flow out toward a pipe 4. In other words, when the heat exchanger 1 acts as the evaporator, the relay passages 40A cause the refrigerant flowing from the one inlet 40Aa to flow out of the plurality of outlets 40Ab. Refrigerant having a property of causing disproportionation, such as R1123 refrigerant and a mixed refrigerant containing R1123 refrigerant, is used.

When the heat exchanger 1 acts as a condenser, the refrigerant in the pipe 4 flows into the merging passage 80A. The refrigerant flowing into the merging passage 80A is branched to the plurality of first heat transfer pipes 11 to flow into the branch passages 42A. Streams of the refrigerant flowing into the branch passages 42A are merged together, and then pass through the pipes 41 to flow into the second heat transfer pipes 21. Streams of the refrigerant passing through the second heat transfer pipes 21 flow into the pipes 3, and are merged together in the distributor 2. In other words, when the heat exchanger 1 acts as the condenser, each of the relay passages 40A causes the refrigerant flowing from the plurality of outlets 40Ab to flow out of the one inlet 40Aa.

<Details of Stacking Type Header>

Figure 4:
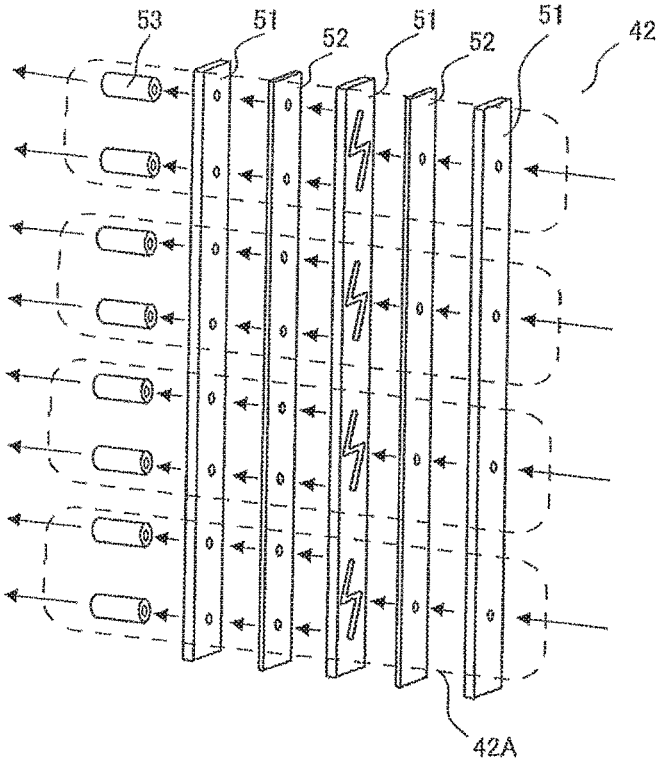
FIG. 4 is an exploded perspective view of a stacking type header of the heat exchanger according to Embodiment 1.

FIG. 4 is an exploded perspective view of the stacking type header of the heat exchanger according to Embodiment 1. In FIG. 4, a flow of the refrigerant when the heat exchanger 1 acts as the evaporator is indicated by the black arrows.

As illustrated in FIG. 4, the stacking type header 42 is constructed by alternately stacking a plurality of bare materials 51, to which no brazing material is applied to both surfaces of each of the plurality of bare materials 51, and a plurality of cladding materials 52, to which a brazing material is applied to both surfaces of each of the plurality of cladding materials 52. The bare materials 51 and the cladding materials 52 are stacked so that through holes bored in the bare materials 51 and the cladding materials 52 are coupled to form the plurality of branch passages 42A. Each of the branch passages 42A branches the refrigerant flowing from the one inlet and causes the refrigerant to flow out of the plurality of outlets, without merging streams of the refrigerant together midway through each of the branch passages 42A. A plurality of through holes in the bare material 51 closest to the first heat transfer pipes 11 are joined to a plurality of joint pipes 53 connected to the first heat transfer pipes 11.

FIG. 4 is an illustration of the case where each of the branch passages 42A branches the refrigerant flowing from the one inlet into two streams, and causes the refrigerant to flow out of the plurality of outlets, but each of the branch passages 42A may branch the refrigerant flowing from the one inlet into three or more streams, and cause the refrigerant to flow out of the plurality of outlets. Further, FIG. 4 is an illustration of the case where each of the branch passages 42A branches the refrigerant into two streams only once, but each of the branch passages 42A may repeatedly branch the refrigerant into two streams multiple times. With this configuration, uniformity of the distribution of the refrigerant is enhanced. In particular, when the first heat transfer pipes 11 are arranged side by side in a direction intersecting with a horizontal direction, the uniformity of the distribution of the refrigerant is significantly enhanced. Further, the flat pipes 11*a* may be directly connected to the branch passages 42A. In other words, the first heat transfer pipes 11 may not include the joint pipes 11*b*. The stacking type header 42 may be a header of an other type, such as a tubular header.

<Details of Tubular Header>

Figure 5:
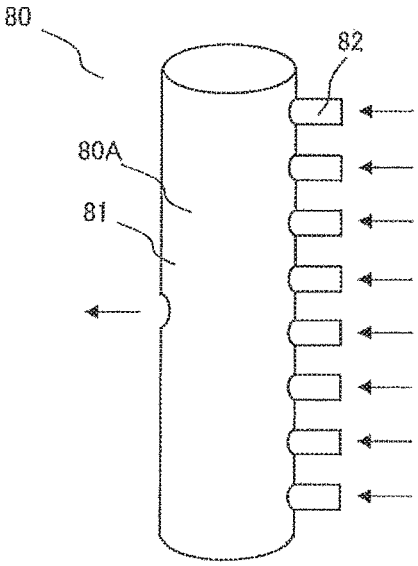
FIG. 5 is a perspective view of a tubular header of the heat exchanger according to Embodiment 1.

FIG. 5 is a perspective view of the tubular header of the heat exchanger according to Embodiment 1. In FIG. 5, a flow of the refrigerant when the heat exchanger 1 acts as the evaporator is indicated by the black arrows.

As illustrated in FIG. 5, the tubular header 80 is arranged so that an axial direction of a cylindrical portion 81 having a closed end portion on one side and a closed end portion on an other side intersects with the horizontal direction. A plurality of joint pipes 82 connected to the first heat transfer pipes 11 are joined to a side wall of the cylindrical portion 81. The flat pipes 11*a* may be directly connected to the merging passage 80A. In other words, the first heat transfer pipes 11 may not include the joint pipes 11*b*. The tubular header 80 may be a header of an other type.

<Details of Relay Unit>

Each of the pipes 41 connects one of the second heat transfer pipes 21 and one inlet of the branch passages 42A so that streams of the refrigerant are not merged together in the pipe 41. Further, each of the branch passages 42A branches the refrigerant flowing from the one inlet and causes the refrigerant to flow out of the plurality of outlets, without merging the streams of the refrigerant together midway through each of the branch passages 42A. In other words, each of the relay passages 40A distributes the refrigerant flowing from the one inlet 40Aa, without merging streams of the refrigerant together, and causes the refrigerant to flow out of the plurality of outlets 40Ab. With this configuration, a pressure loss of the refrigerant passing through the relay unit 40 is reduced.

Consequently, in the refrigeration cycle apparatus, such as an air-conditioning apparatus, including the heat exchanger 1 as described above, when the refrigerant is changed to the refrigerant having the property of causing the disproportionation, such as R1123 refrigerant and the mixed refrigerant containing R1123 refrigerant, the operation efficiency is enhanced to reduce a discharge temperature so that the refrigerant is prevented from causing the disproportionation. Further, the number of relay passages 40A is smaller than the number of paths in the main heat exchange unit 10 and the sub-heat exchange unit 20, and hence the occlusion that occurs in the relay passages 40A significantly contributes to a reduction in performance of the heat exchanger 1. Consequently, the production of the sludge, that is, the occlusion is suppressed in the relay passages 40A to effectively suppress the reduction in performance of the heat exchanger 1.

Further, the heat exchanger 1 is preferably configured so that the pressure loss of the refrigerant passing through the relay unit 40 is smaller than a pressure loss of the refrigerant passing through the sub-heat exchange unit 20. When the heat exchanger 1 acts as the evaporator, refrigerant in a liquid phase state or a low-quality (low-dryness) two-phase state passes through the second heat transfer pipes 21, and refrigerant in an intermediate-quality two-phase state passes through the pipes 41. Further, when the heat exchanger 1 acts as the condenser, the refrigerant in the intermediate-quality two-phase state passes through the pipes 41, and the refrigerant in the liquid phase state or the low-quality two-phase state passes through the second heat transfer pipes 21. Further, the refrigerant in the liquid phase state or the low-quality two-phase state has lower performance of heat transfer than the refrigerant in the intermediate-quality two-phase state.

Consequently, with this configuration, when the heat exchanger 1 acts as the evaporator and when the heat exchanger 1 acts as the condenser, a flow rate of the refrigerant is increased in the second heat transfer pipes 21, through which the refrigerant in the liquid phase state or the low-quality two-phase state having low performance of heat transfer passes, and heat transfer in the sub-heat exchange unit 20 is preferentially promoted to enhance the performance of heat transfer of the heat exchanger 1. Further, when the heat exchanger 1 acts as the condenser, a liquid film is formed in the second heat transfer pipes 21, through which the refrigerant in the liquid phase state or the low-quality two-phase state passes, to inhibit the heat transfer. This phenomenon is prevented with enhancement of liquid drainage performance accompanying the increase in flow rate of the refrigerant, with the result that heat exchange performance of the heat exchanger 1 is enhanced.

Further, the heat exchanger 1 is preferably configured so that the pressure loss of the refrigerant passing through the relay unit 40 is larger than a pressure loss of the refrigerant passing through the main heat exchange unit 10. Of the pressure loss of the refrigerant passing through the heat exchanger 1, the pressure loss of the refrigerant passing through the main heat exchange unit 10 is dominant. Consequently, this configuration achieves both of the reduction in pressure loss of the refrigerant passing through the heat exchanger 1, and increases in pitch of the fins 30, number of fins 30, and other factors to secure heat exchange areas of the main heat exchange unit 10 and the sub-heat exchange unit 20 by increasing the pressure loss caused in the relay passages 40A of the relay unit 40 to reduce a space for the relay unit 40. Further, when the heat exchanger 1 acts as the evaporator, the refrigerant becomes easier to be supplied to the main heat exchange unit 10 located above in the gravity direction, to thereby suppress deterioration of performance of distributing the refrigerant caused when the flow rate of the refrigerant is low.

Further, each of the relay passages 40A preferably has a passage cross-sectional area equal to or more than a passage cross-sectional area of the corresponding one of the second heat transfer pipes 21 connected to the one inlet 40Aa of the relay passage 40A, and is equal to or less than a total of passage cross-sectional areas of the plurality of first heat transfer pipes 11 connected to the plurality of outlets 40Ab of the relay passage 40A. In a region of each of the relay passages 40A through which the refrigerant before being branched passes, the passage cross-sectional area of each of the relay passages 40A is defined as a cross-sectional area of one passage, and in a region of each of the relay passages 40A through which the refrigerant after being branched passes, the passage cross-sectional area of each of the relay passages 40A is defined as a total of cross-sectional areas of a plurality of passages.

A pressure loss ΔP [kPa] of the refrigerant passing through the relay unit 40 is expressed by the following expression using an average passage length L [m] of the plurality of relay passages 40A, an average hydraulic equivalent diameter d [m] of the plurality of relay passages 40A, a number N of relay passages 40A, and a coefficient a. The passage length of each of the relay passages 40A is defined as a total of a passage length of one passage in the region of each of the relay passages 40A through which the refrigerant before being branched passes, and an average of passage lengths of a plurality of passages in the region of each of the relay passages 40A through which the refrigerant after being branched passes. In the region of each of the relay passages 40A through which the refrigerant before being branched passes, a hydraulic equivalent diameter of each of the relay passages 40A is defined by a cross-sectional area of one passage and a wetted perimeter length of one passage, and in the region of each of the relay passages 40A through which the refrigerant after being branched passes, the hydraulic equivalent diameter of each of the relay passages 40A is defined by a total of cross-sectional areas of the plurality of passages and a total of wetted perimeter lengths of the plurality of passages.

[Math. 1]

$$\Delta P = a \times L / (d^5 \times N^2) \quad (1)$$

Consequently, in the pressure loss ΔP [kPa] of the refrigerant passing through the relay unit 40, the average hydraulic equivalent diameter d [m] of the plurality of relay passages 40A and the number N of the relay passages 40A are dominant.

Consequently, the passage cross-sectional area of each of the relay passages 40A is defined as described above so that a configuration can be easily achieved to be substantially similar to a configuration with which the pressure loss of the refrigerant passing through the relay unit 40 is smaller than the pressure loss of the refrigerant passing through the sub-heat exchange unit 20, and is larger than the pressure loss of the refrigerant passing through the main heat exchange unit 10.

Further, the average passage length L [m] of the plurality of relay passages 40A, the average hydraulic equivalent diameter d [m] of the plurality of relay passages 40A, and the number N of the relay passages 40A preferably satisfy a relationship expressed by the following expression.

[Math. 2]

$$4.3\times10^{6}\leq L/(d^{5}\times N^{2})\leq 3.0\times10^{10} \quad (2)$$

Figure 6:
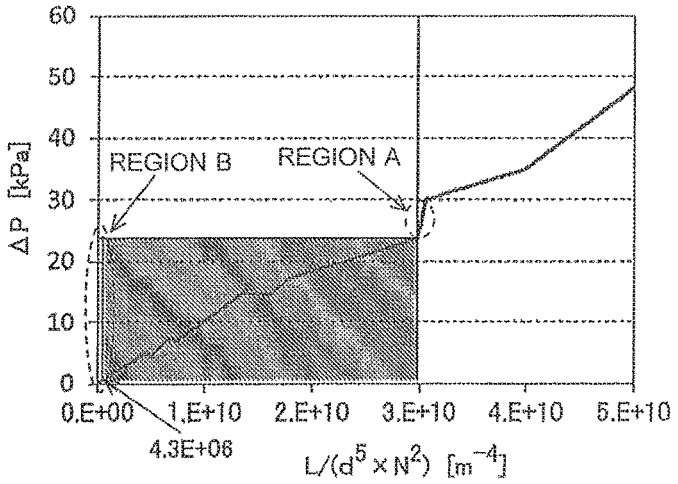
FIG. 6 is a graph for showing a relationship among an average passage length of a plurality of relay passages, an average hydraulic equivalent diameter of the plurality of relay passages, the number of relay passages, and a pressure loss of refrigerant passing through the relay unit of the heat exchanger according to Embodiment 1.

FIG. 6 is a graph for showing a relationship among the average passage length of the plurality of relay passages, the average hydraulic equivalent diameter of the plurality of relay passages, the number of relay passages, and the pressure loss of the refrigerant passing through the relay unit of the heat exchanger according to Embodiment 1.

As shown in FIG. 6, the pressure loss ΔP [kPa] of the refrigerant passing through the relay unit 40 is increased rapidly in a region A in which $L/(d^5\times N^2)$ exceeds $3.0\times10^{10}$. Further, in a region B in which $L/(d^5\times N^2)$ does not exceed $4.3\times10^6$, the pressure loss ΔP [kPa] of the refrigerant passing through the relay unit 40 is too small, that is, the relay unit 40 is increased in size, with the result that the heat exchange performance of the heat exchanger 1 is not secured.

Consequently, the average passage length L [m] of the plurality of relay passages 40A, the average hydraulic equivalent diameter d [m] of the plurality of relay passages 40A, and the number N of the relay passages 40A are defined as described to achieve both of the reduction in pressure loss ΔP [kPa] of the refrigerant passing through the relay unit 40, and the securement of the heat exchange performance of the heat exchanger 1.

<Air-Conditioning Apparatus to which Heat Exchanger is Applied>

Figure 7:
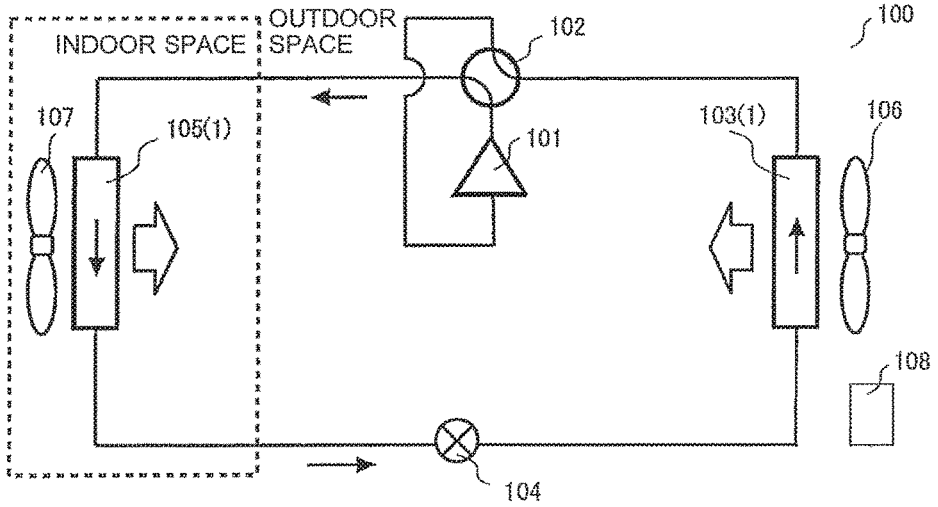
FIG. 7 is a diagram for illustrating a configuration and an operation of an air-conditioning apparatus to which the heat exchanger according to Embodiment 1 is applied.
Figure 8:
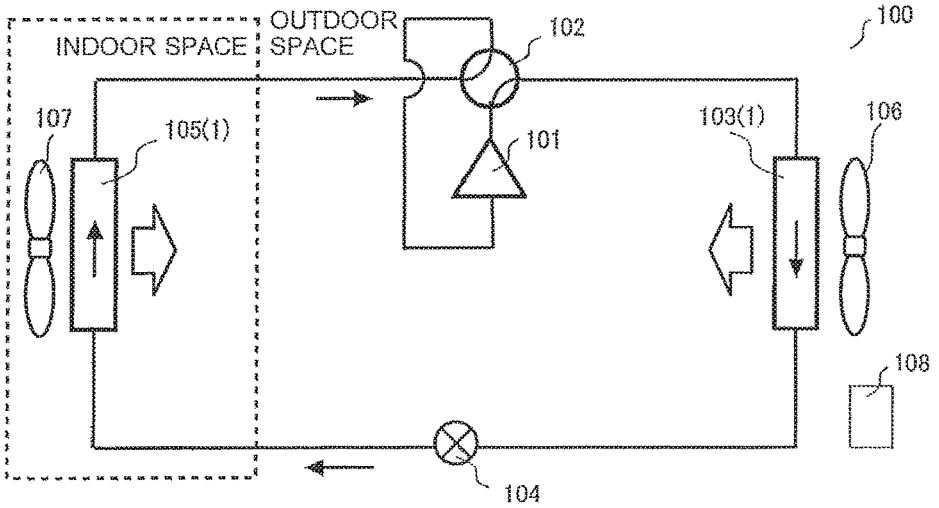
FIG. 8 is a diagram for illustrating the configuration and the operation of the air-conditioning apparatus to which the heat exchanger according to Embodiment 1 is applied.

FIG. 7 and FIG. 8 are diagrams for illustrating the configuration and operation of the air-conditioning apparatus to which the heat exchanger according to Embodiment 1 is applied. FIG. 7 is an illustration of a case where an air-conditioning apparatus 100 performs a heating operation. Further, FIG. 8 is an illustration of a case where the air-conditioning apparatus 100 performs a cooling operation.

As illustrated in FIG. 7 and FIG. 8, the air-conditioning apparatus 100 includes a compressor 101, a four-way valve 102, an outdoor heat exchanger (heat source-side heat exchanger) 103, an expansion device 104, an indoor heat exchanger (load-side heat exchanger) 105, an outdoor fan (heat source-side fan) 106, an indoor fan (load-side fan) 107, and a controller 108. The compressor 101, the four-way valve 102, the outdoor heat exchanger 103, the expansion device 104, and the indoor heat exchanger 105 are connected by pipes to form a refrigerant circuit. The four-way valve 102 may be any other flow switching device. The outdoor fan 106 may be arranged on the windward side of the outdoor heat exchanger 103, or on the leeward side of the outdoor heat exchanger 103. Further, the indoor fan 107 may be arranged on the windward side of the indoor heat exchanger 105, or on the leeward side of the indoor heat exchanger 105.

The controller 108 is connected to, for example, the compressor 101, the four-way valve 102, the expansion device 104, the outdoor fan 106, the indoor fan 107, and various sensors. The controller 108 switches the flow passage of the four-way valve 102 to switch between the heating operation and the cooling operation.

As illustrated in FIG. 7, when the air-conditioning apparatus 100 performs the heating operation, the high-pressure and high-temperature refrigerant discharged from the compressor 101 passes through the four-way valve 102 to flow into the indoor heat exchanger 105, and is condensed through heat exchange with air supplied by the indoor fan 107, to thereby heat the inside of a room. The condensed refrigerant flows out of the indoor heat exchanger 105 and then turns into low-pressure refrigerant by the expansion device 104. The low-pressure refrigerant flows into the outdoor heat exchanger 103, and is evaporated through heat exchange with air supplied by the outdoor fan 106. The evaporated refrigerant flows out of the outdoor heat exchanger 103 and passes through the four-way valve 102 to be sucked into the compressor 101. In other words, during the heating operation, the outdoor heat exchanger 103 acts as the evaporator, and the indoor heat exchanger 105 acts as the condenser.

As illustrated in FIG. 8, when the air-conditioning apparatus 100 performs the cooling operation, the high-pressure and high-temperature refrigerant discharged from the compressor 101 passes through the four-way valve 102 to flow into the outdoor heat exchanger 103, and is condensed through heat exchange with air supplied by the outdoor fan 106. The condensed refrigerant flows out of the outdoor heat exchanger 103 and then turns into low-pressure refrigerant by the expansion device 104. The low-pressure refrigerant flows into the indoor heat exchanger 105, and is evaporated through heat exchange with air supplied by the indoor fan 107, to thereby cool the inside of the room. The evaporated refrigerant flows out of the indoor heat exchanger 105 and passes through the four-way valve 102 to be sucked into the compressor 101. In other words, during the cooling operation, the outdoor heat exchanger 103 acts as the condenser, and the indoor heat exchanger 105 acts as the evaporator.

The heat exchanger 1 is used as at least one of the outdoor heat exchanger 103 or the indoor heat exchanger 105. The heat exchanger 1 is connected so that each of the relay passages 40A is configured to cause the refrigerant flowing from the one inlet 40Aa to flow out of the plurality of outlets 40Ab when the heat exchanger 1 acts as the evaporator, and so that each of the relay passages 40A is configured to cause the refrigerant flowing from the plurality of outlets 40Ab to flow out of the one inlet 40Aa when the heat exchanger 1 acts as the condenser.

Embodiment 2

A heat exchanger according to Embodiment 2 of the present invention is described.

Overlapping description or similar description to that of Embodiment 1 is appropriately simplified or omitted.

<Outline of Heat Exchanger>

Figure 9:
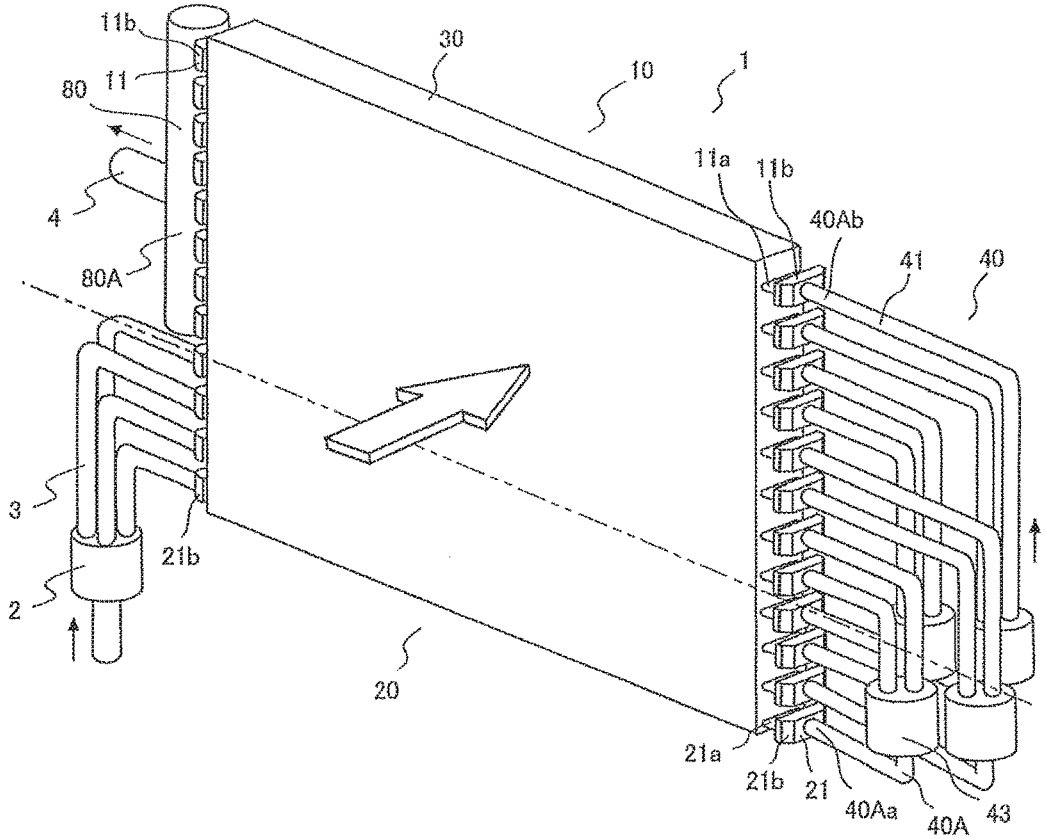
FIG. 9 is a perspective view of a heat exchanger according to Embodiment 2 of the present invention.

FIG. 9 is a perspective view of the heat exchanger according to Embodiment 2. In FIG. 9, a flow of refrigerant when a heat exchanger 1 acts as an evaporator is indicated by the black arrows. Further, in FIG. 9, a flow of air for exchanging heat with the refrigerant in the heat exchanger 1 is indicated by the white arrow.

As illustrated in FIG. 9, the relay unit 40 includes a plurality of pipes 41, and a plurality of distributors 43. Each of the plurality of distributors 43 has an inlet connected to a corresponding one of the pipes 41, and a plurality of outlets connected to corresponding ones of the plurality of pipes 41, to thereby form each of a plurality of relay passages 40A. In other words, the relay passages 40A are formed of the pipes 41 and the distributors 43, with inlets of the pipes 41 connected to the inlets of the distributors 43 serving as inlets 40Aa of the relay passages 40A, and with outlets of the pipes 41 connected to the outlets of the distributors 43 serving as outlets 40Ab of the relay passages 40A.

<Details of Relay Unit>

The one pipe 41 connected to the inlet of each of the distributors 43 is branched into the plurality of pipes 41 connected to the outlets of each of the distributors 43, without merging streams of the refrigerant together midway through each of the distributors 43. In other words, each of the relay passages 40A distributes the refrigerant flowing from the one inlet 40Aa, without merging the streams of the refrigerant together, and causes the refrigerant to flow out of the plurality of outlets 40Ab. With this configuration, a pressure loss of the refrigerant passing through the relay unit 40 is reduced. In other words, also in the relay unit 40 of the heat exchanger 1 according to Embodiment 2, a configuration can be adopted to be similar to that of the relay unit 40 of the heat exchanger 1 according to Embodiment 1, and similar actions to those of the relay unit 40 of the heat exchanger 1 according to Embodiment 1 are attained.

Further, with each of the pipes 41 having a hydraulic equivalent diameter sufficiently smaller than a stage pitch Dp [m] of the first heat transfer pipes 11 and the second heat transfer pipes 21, the same number of pipes 41 as the number of first heat transfer pipes 11 and the number of second heat transfer pipes 21 can be connected, and hence design flexibility of the relay unit 40 is enhanced, with the result that the space for the relay unit 40 can be reduced. Further, the need for a stacking type header 42 is eliminated to reduce a movement of heat, with the result that heat exchange performance during a normal operation is enhanced. Further, a capacity is reduced by that of the stacking type header 42 to reduce operating time during a defrosting operation.

Embodiment 3

A heat exchanger according to Embodiment 3 of the present invention is described.

Overlapping description or similar description to that of each of Embodiment 1 and Embodiment 2 is appropriately simplified or omitted.

<Outline of Heat Exchanger>

Figure 10:
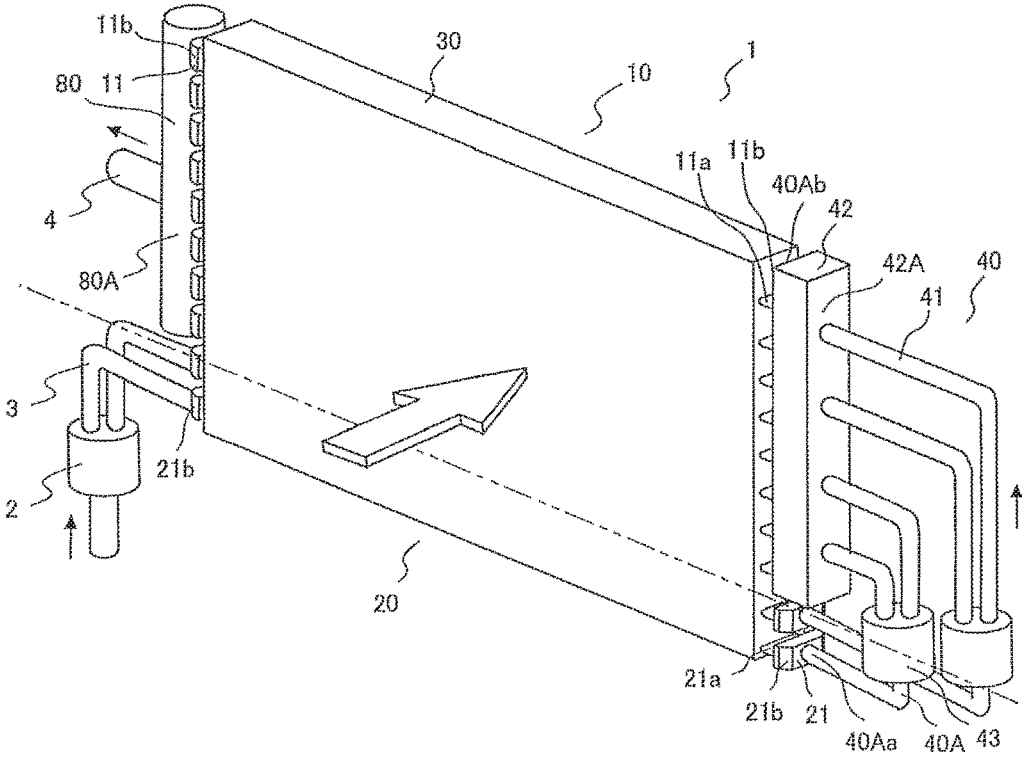
FIG. 10 is a perspective view of a heat exchanger according to Embodiment 3 of the present invention.

FIG. 10 is a perspective view of the heat exchanger according to Embodiment 3. In FIG. 10, a flow of refrigerant when a heat exchanger 1 acts as an evaporator is indicated by the black arrows. Further, in FIG. 10, a flow of air for exchanging heat with the refrigerant in the heat exchanger 1 is indicated by the white arrow.

As illustrated in FIG. 10, a relay unit 40 includes a plurality of pipes 41, a plurality of distributors 43, and a stacking type header 42 including a plurality of branch passages 42A formed in the stacking type header 42. Each of the plurality of distributors 43 has an inlet connected to one pipe 41, and a plurality of outlets connected to corresponding ones of the plurality of pipes 41, and one end of each of the plurality of pipes 41 connected to the plurality of outlets of the distributors 43 is connected to an inlet of each of the plurality of branch passages 42A to thereby form each of a plurality of relay passages 40A. In other words, the relay passages 40A are formed of the pipes 41, the distributors 43, and the branch passages 42A formed in the stacking type header 42, with inlets of the pipes 41 connected to the inlets of the distributors 43 serving as inlets 40Aa of the relay passages 40A, and with outlets of the branch passages 42A serving as outlets 40Ab of the relay passages 40A.

<Details of Relay Unit>

The one pipe 41 connected to the inlet of each of the distributors 43 is branched into the plurality of pipes 41 connected to the outlets of each of the distributors 43, without merging streams of the refrigerant together midway through each of the distributors 43. Further, each of the branch passages 42A branches the refrigerant flowing from the one inlet and causes the refrigerant to flow out of the plurality of outlets, without merging streams of the refrigerant together midway through each of the branch passages 42A. In other words, each of the relay passages 40A distributes the refrigerant flowing from the one inlet 40Aa, without merging the streams of the refrigerant together, and causes the refrigerant to flow out of the plurality of outlets 40Ab. With this configuration, a pressure loss of the refrigerant passing through the relay unit 40 is reduced. In other words, also in the relay unit 40 of the heat exchanger 1 according to Embodiment 3, a configuration can be adopted to be similar to that of the relay unit 40 of the heat exchanger 1 according to Embodiment 1, and similar actions to those of the relay unit 40 of the heat exchanger 1 according to Embodiment 1 are attained.

Further, with the use of both of the stacking type header 42 and the distributors 43, the number of pipes 41 can be reduced while the number of first heat transfer pipes 11 connected to each of the relay passages 40A, leading to a reduced space for the relay unit 40.

Embodiment 4

A heat exchanger according to Embodiment 4 of the present invention is described.

Overlapping description or similar description to that of each of Embodiment 1 to Embodiment 3 is appropriately simplified or omitted. Further, a following case is described where a relay unit of the heat exchanger according to Embodiment 4 is the same as the relay unit of the heat exchanger according to Embodiment 1, but the relay unit of the heat exchanger according to Embodiment 4 may be the same as the relay unit of the heat exchanger according to Embodiment 2 or Embodiment 3.

<Outline of Heat Exchanger>

Figure 11:
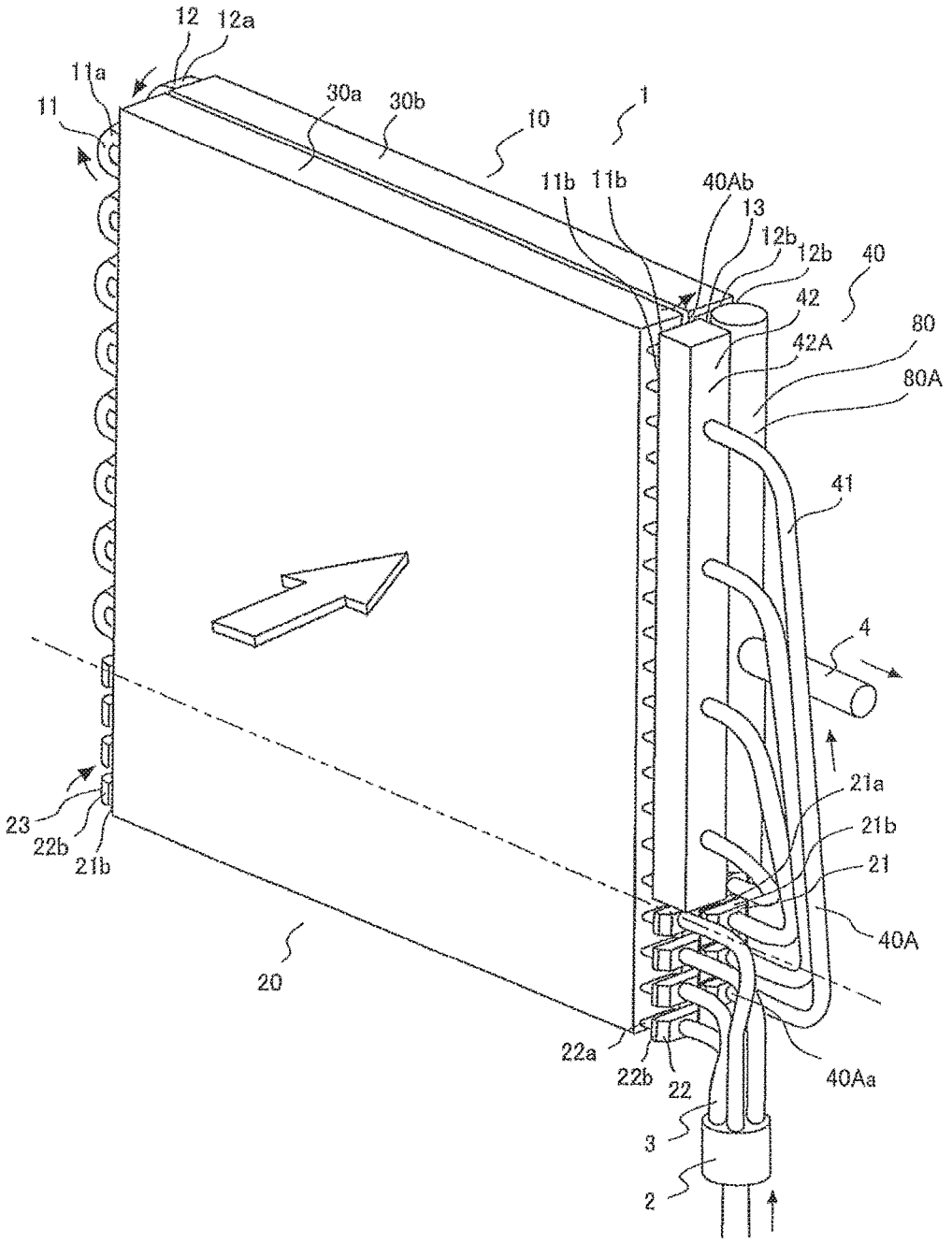
FIG. 11 is a perspective view of a heat exchanger according to Embodiment 4 of the present invention.
Figure 12:
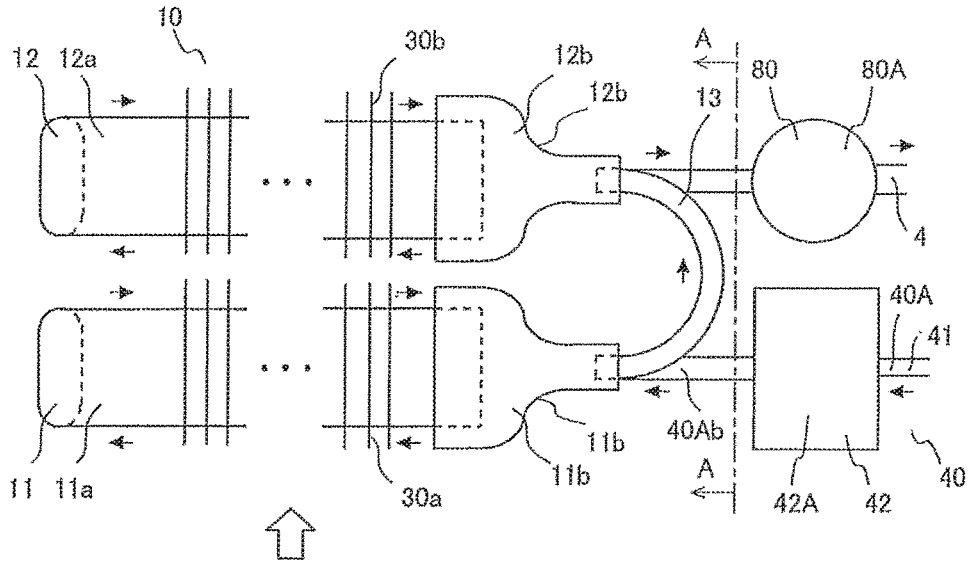
FIG. 12 is a top view of a main heat exchange unit and a part of a relay unit of the heat exchanger according to Embodiment 4.
Figure 13:
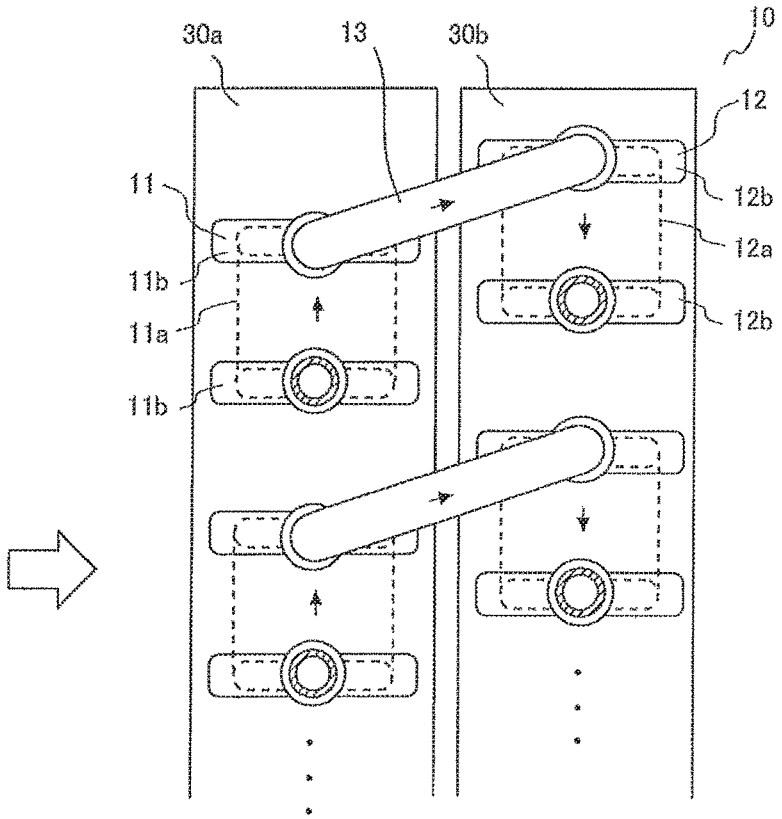
FIG. 13 is a sectional view of the heat exchanger according to Embodiment 4 taken along the line A-A of FIG. 12.
Figure 14:
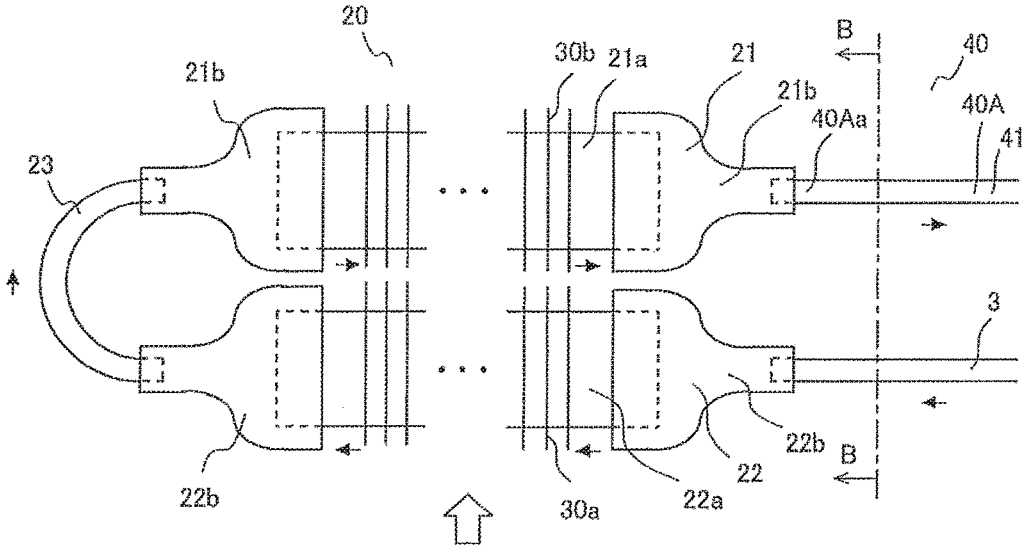
FIG. 14 is a top view of a sub-heat exchange unit and a part of the relay unit of the heat exchanger according to Embodiment 4.
Figure 15:
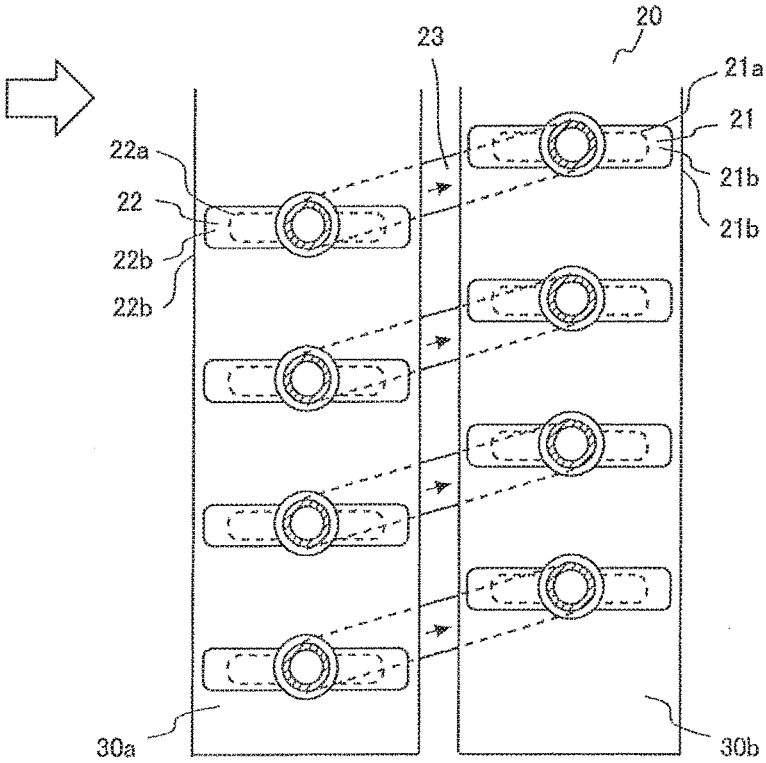
FIG. 15 is a sectional view of the heat exchanger according to Embodiment 4 taken along the line B-B of FIG. 14.

FIG. 11 is a perspective view of the heat exchanger according to Embodiment 4. FIG. 12 is a top view of a main heat exchange unit and a part of the relay unit of the heat exchanger according to Embodiment 4. FIG. 13 is a sectional view of the heat exchanger according to Embodiment 4 taken along the line A-A of FIG. 12. FIG. 14 is a top view of a sub-heat exchange unit and a part of the relay unit of the heat exchanger according to Embodiment 4. FIG. 15 is a sectional view of the heat exchanger according to Embodiment 4 taken along the line B-B of FIG. 14. In FIG. 11 to FIG. 15, a flow of refrigerant when a heat exchanger 1 acts as an evaporator is indicated by the black arrows. Further, in FIG. 11 to FIG. 15, a flow of air for exchanging heat with the refrigerant in the heat exchanger 1 is indicated by the white arrow.

As illustrated in FIG. 11 to FIG. 15, the heat exchanger 1 includes a main heat exchange unit 10 and a sub-heat exchange unit 20. The main heat exchange unit 10 includes a plurality of first heat transfer pipes 11 arranged side by side, and a plurality of third heat transfer pipes 12 arranged side by side and located on the leeward side of the plurality of first heat transfer pipes 11. The sub-heat exchange unit 20 includes a plurality of second heat transfer pipes 21 arranged side by side, and a plurality of fourth heat transfer pipes 22 arranged side by side and located on the windward side of the plurality of second heat transfer pipes 21. Each of the third heat transfer pipes 12 includes a flat pipe 12*a*, in which a plurality of passages are formed, and joint pipes 12*b* attached to both ends of the flat pipe 12*a*. Each of the fourth heat transfer pipes 22 includes a flat pipe 22*a*, in which a plurality of passages are formed, and joint pipes 22*b* attached to both ends of the flat pipe 22*a*. Each of the joint pipes 12*b* has a function of combining the plurality of passages formed in a corresponding one of the flat pipes 12*a* into one passage, and each of the joint pipes 22*b* has a function of combining the plurality of passages formed in a corresponding one of the flat pipes 22*a* into one passage. When each of the flat pipe 12*a* and the flat pipe 22*a* is a circular pipe, in which one passage is formed, the third heat transfer pipes 12 and the fourth heat transfer pipes 22 do not include the joint pipes 12*b* and the joint pipes 22*b*, respectively.

Each of the flat pipes 11*a* and the flat pipes 12*a* is bent back at an intermediate portion of each of the flat pipes 11*a* and the flat pipes 12*a*. The turn-back portion may be formed of a joint pipe. The flat pipes 11*a* and the flat pipes 12*a* are arranged to be shifted in position in a height direction. The flat pipes 22*a* and the flat pipes 21*a* are arranged to be shifted in position in the height direction. With this configuration, heat exchange performance is enhanced.

Windward fins 30*a* are joined by, for example, brazing to each extend across the plurality of first heat transfer pipes 11 and the plurality of fourth heat transfer pipes 22. Leeward fins 30*b* are joined by, for example, brazing to each extend across the plurality of third heat transfer pipes 12 and the plurality of second heat transfer pipes 21. The windward fins 30*a* may be divided into a part extending across the plurality of first heat transfer pipes 11 and a part extending across the plurality of fourth heat transfer pipes 22. The leeward fins 30*b* may be divided into a part extending across the plurality of third heat transfer pipes 12 and a part extending across the plurality of second heat transfer pipes 21.

The plurality of first heat transfer pipes 11 and the plurality of second heat transfer pipes 21 are connected to each other by a plurality of relay passages 40A formed in a relay unit 40. Each of the plurality of first heat transfer pipes 11 has one end connected to a corresponding one of a plurality of outlets 40Ab of the plurality of relay passages 40A formed in the relay unit 40, and an other end connected to one end of a corresponding one of the plurality of third heat transfer pipes 12 through a lateral bridging pipe 13. Each of the plurality of second heat transfer pipes 21 has one end connected to one end of a corresponding one of the plurality of fourth heat transfer pipes 22 through a lateral bridging pipe 23, and an other end connected to an inlet 40Aa of a corresponding one of the plurality of relay passages 40A formed in the relay unit 40. Each of the plurality of third heat transfer pipes 12 has an other end connected to a tubular header 80.

When the heat exchanger 1 acts as the evaporator, the refrigerant branched by a distributor 2 passes through pipes 3 to flow into the fourth heat transfer pipes 22. The refrigerant passing through the fourth heat transfer pipes 22 passes through the lateral bridging pipes 23 to be transferred to the leeward side, and flows into the second heat transfer pipes 21. The refrigerant passing through the second heat transfer pipes 21 passes through the pipes 41 to flow into the branch passages 42A. The refrigerant flowing into the branch passages 42A is branched, and streams of the refrigerant flow into the first heat transfer pipes 11 to be turned back. Then, the streams of the refrigerant pass through the lateral bridging pipes 13 to be transferred to the leeward side, and flow into the third heat transfer pipes 12. The streams of the refrigerant passing through the third heat transfer pipes 12 flow into a merging passage 80A to be merged together, and then flow out toward a pipe 4. In other words, when the heat exchanger 1 acts as the evaporator, the relay passages 40A cause the refrigerant flowing from the one inlet 40Aa to flow out of the plurality of outlets 40Ab.

When the heat exchanger 1 acts as a condenser, the refrigerant in the pipe 4 flows into the merging passage 80A. The refrigerant flowing into the merging passage 80A is distributed into the plurality of third heat transfer pipes 12 to be turned back. Then, streams of the refrigerant pass through the lateral bridging pipes 13 to be transferred to the windward side, and flow into the first heat transfer pipes 11. The streams of the refrigerant passing through the first heat transfer pipes 11 flow into the branch passages 42A to be merged together, and then pass through the pipes 41 to flow into the second heat transfer pipes 21. The refrigerant passing through the second heat transfer pipes 21 passes through the lateral bridging pipes 23 to be transferred to the windward side, and flows into the fourth heat transfer pipes 22. Streams of the refrigerant passing through the fourth heat transfer pipes 22 flow into the pipes 3, and are merged together in the distributor 2. In other words, when the heat exchanger 1 acts as the condenser, each of the relay passages 40A causes the refrigerant flowing from the plurality of outlets 40Ab to flow out of the one inlet 40Aa.

<Details of Relay Unit>

Each of the pipes 41 connects one of the second heat transfer pipes 21 and one inlet of the branch passages 42A so that streams of the refrigerant are not merged together in the pipe 41. Further, each of the branch passages 42A branches the refrigerant flowing from the one inlet and causes the refrigerant to flow out of the plurality of outlets, without merging the streams of the refrigerant together midway through each of the branch passages 42A. In other words, each of the relay passages 40A distributes the refrigerant flowing from the one inlet 40Aa, without merging streams of the refrigerant together, and causes the refrigerant to flow out of the plurality of outlets 40Ab. With this configuration, a pressure loss of the refrigerant passing through the relay unit 40 is reduced. In other words, also in the relay unit 40 of the heat exchanger 1 according to Embodiment 4, a configuration can be adopted to be similar to that of the relay unit 40 of the heat exchanger 1 according to Embodiment 1, and similar actions to those of the relay unit 40 of the heat exchanger 1 according to Embodiment 1 are attained.

Further, the main heat exchange unit 10 includes the plurality of first heat transfer pipes 11 arranged side by side, and the plurality of third heat transfer pipes 12 arranged side by side and located on the leeward side of the plurality of first heat transfer pipes 11, and the sub-heat exchange unit 20 includes the plurality of second heat transfer pipes 21 arranged side by side, and the plurality of fourth heat transfer pipes 22 arranged side by side and located on the windward side of the plurality of second heat transfer pipes 21. Consequently, when the heat exchanger 1 acts as the condenser, the refrigerant can be transferred from the leeward side to the windward side, that is, caused to flow counter to an air flow, to thereby enhance heat exchange performance of the heat exchanger 1. Even with such a configuration, the pressure loss of the refrigerant passing through the relay unit 40 is reduced.

In particular, due to a low critical point of the refrigerant having the property of causing the disproportionation, such as R1123 refrigerant and the mixed refrigerant containing R1123 refrigerant, an increase in proportion of a liquid portion and a further reduction in heat exchange performance are suppressed by causing the refrigerant to flow counter to the air flow to facilitate heat transfer of the liquid portion. In other words, causing the refrigerant to flow counter to the air flow is particularly effective in the heat exchanger 1 to which refrigerant having a property of causing disproportionation, such as R1123 refrigerant and a mixed refrigerant containing R1123 refrigerant, is applied.

Further, as the stacking type header 42 and the tubular header 80 are arranged side by side on one side of the main heat exchange unit 10, the heat exchanger 1 may be bent into, for example, an L shape after the stacking type header 42 and the tubular header 80 are joined by brazing. When the stacking type header 42 and the tubular header 80 are joined by brazing after the heat exchanger 1 is bent, due to a large number of joining positions, a need arises to join the first heat transfer pipes 11 and the third heat transfer pipes 12 to the windward fins 30*a* and the leeward fins 30*b* by brazing in a furnace and bend the heat exchanger 1, and then to join the stacking type header 42 and the tubular header 80 to the heat exchanger 1 again by brazing in the furnace. In joining again by brazing in the furnace, a brazing filler metal at the positions previously joined by brazing is melted to cause a joining failure, and productivity is reduced. In contrast, when the heat exchanger 1 is bent after the stacking type header 42 and the tubular header 80 are joined by brazing, tasks to be performed after the joining include only joining of the pipes 41 and other components, which can be joined by brazing without being put into the furnace. As a result, a production cost, the productivity, and other related effects are enhanced. Even with such a configuration, the pressure loss of the refrigerant passing through the relay unit 40 is reduced.

Further, although the stacking type header 42 and the tubular header 80 are arranged side by side, the stacking type header 42 and the tubular header 80 are constructed separately. Consequently, reduction in heat exchange efficiency of the heat exchanger 1 due to heat exchange between streams of the refrigerant before and after heat exchange in the main heat exchange unit 10 is reduced. Further, the configuration in which the sub-heat exchange unit 20 is not brought into contact with the stacking type header 42 and the tubular header 80 is adopted, and hence the reduction in heat exchange efficiency of the heat exchanger 1 is further reduced. Even with such a configuration, the pressure loss of the refrigerant passing through the relay unit 40 is reduced.

REFERENCE SIGNS LIST

1 heat exchanger 2 distributor 3 pipe 4 pipe 10 main heat exchange unit 11 first heat transfer pipe 11*a* flat pipe 11*b* joint pipe
12 third heat transfer pipe 12*a* flat pipe 12*b* joint pipe 13 lateral bridging pipe 20 sub-heat exchange unit 21 second heat transfer pipe 21*a* flat pipe 21*b* joint pipe 22 fourth heat transfer pipe 22*a* flat pipe 22*b* joint pipe 23 lateral bridging pipe 30 fin 30*a* windward fin
30*b* leeward fin 40 relay unit 40A relay passage 40Aa inlet
40Ab outlet 41 pipe 42 stacking type header 42A branch passage 43 distributor 51 bare material 52 cladding material 53 joint pipe 80 tubular header 80A merging passage 81 cylindrical portion 82 joint pipe 100 air-conditioning apparatus 101 compressor 102 four-way valve 103 outdoor heat exchanger 104 expansion device 105 indoor heat exchanger 106 outdoor fan 107 indoor fan 108 controller

The invention claimed is:

1. A heat exchanger, in which refrigerant causing disproportionation is used, comprising:
- a main heat exchange unit including a plurality of first heat transfer pipes arranged side by side;
- a sub-heat exchange unit located below the main heat exchange unit and including a plurality of second heat transfer pipes arranged side by side; and
- a relay unit including a plurality of relay passages connecting the plurality of first heat transfer pipes and the plurality of second heat transfer pipes,
- each of the plurality of relay passages having one inlet connected to a corresponding one of the plurality of second heat transfer pipes, and a plurality of outlets each connected to a corresponding one of the plurality of first heat transfer pipes,
- each of the plurality of relay passages distributing the refrigerant flowing from the one inlet, without merging streams of the refrigerant together, and causing the refrigerant to flow out of the plurality of outlets.

2. The heat exchanger of claim 1, wherein the relay unit is configured to cause a smaller pressure loss of the refrigerant passing through the relay unit than a pressure loss of the refrigerant passing through the sub-heat exchange unit.

3. The heat exchanger of claim 1, wherein the relay unit is configured to cause a larger pressure loss of the refrigerant passing through the relay unit than a pressure loss of the refrigerant passing through the main heat exchange unit.

4. The heat exchanger of claim 1, wherein each of the plurality of relay passages has a passage cross-sectional area equal to or more than a passage cross-sectional area of the corresponding one of the plurality of second heat transfer pipes connected to the one inlet, and equal to or less than a total of passage cross-sectional areas of the plurality of first heat transfer pipes connected to the plurality of outlets.

5. A heat exchanger, in which refrigerant causing disproportionation is used, comprising:
- a main heat exchange unit including a plurality of first heat transfer pipes arranged side by side;
- a sub-heat exchange unit including a plurality of second heat transfer pipes arranged side by side; and
- a relay unit including a plurality of relay passages connecting the plurality of first heat transfer pipes and the plurality of second heat transfer pipes,
- each of the plurality of relay passages having one inlet connected to a corresponding one of the plurality of second heat transfer pipes, and a plurality of outlets each connected to a corresponding one of the plurality of first heat transfer pipes,
- each of the plurality of relay passages distributing the refrigerant flowing from the one inlet, without merging streams of the refrigerant together, and causing the refrigerant to flow out of the plurality of outlets,
- a relationship expressed by $4.3\times10^{6}\leq L/(d^{5}\times N^{2})\leq 3.0\times10^{10}$ being satisfied, where L [m] represents an average passage length of the plurality of relay passages, d [m] represents an average hydraulic equivalent diameter of the plurality of relay passages, and N represents a number of the plurality of relay passages.

6. A heat exchanger, in which refrigerant causing disproportionation is used, comprising:
- a main heat exchange unit including a plurality of first heat transfer pipes arranged side by side;
- a sub-heat exchange unit including a plurality of second heat transfer pipes arranged side by side; and a relay unit including a plurality of relay passages connecting the plurality of first heat transfer pipes and the plurality of second heat transfer pipes, each of the plurality of relay passages having one inlet connected to a corresponding one of the plurality of second heat transfer pipes, and a plurality of outlets each connected to a corresponding one of the plurality of first heat transfer pipes, each of the plurality of relay passages distributing the refrigerant flowing from the one inlet, without merging streams of the refrigerant together, and causing the refrigerant to flow out of the plurality of outlets, the main heat exchange unit including a plurality of third heat transfer pipes arranged on a leeward side of the plurality of first heat transfer pipes, the sub-heat exchange unit including a plurality of fourth heat transfer pipes arranged on a windward side of the plurality of second heat transfer pipes, each of the plurality of first heat transfer pipes having one end communicating to one of the plurality of outlets, and another end communicating to one of the plurality of third heat transfer pipes, each of the plurality of second heat transfer pipes having one end communicating to one of the plurality of fourth heat transfer pipes, and another end communicating to the one inlet.

7. The heat exchanger of claim 1, wherein the refrigerant causing the disproportionation comprises R1123 refrigerant, or a mixed refrigerant containing R1123 refrigerant.

8. An air-conditioning apparatus comprising the heat exchanger of claim 1, wherein, when the heat exchanger acts as an evaporator, each of the plurality of relay passages causes the refrigerant flowing from the one inlet to flow out of the plurality of outlets, and when the heat exchanger acts as a condenser, each of the plurality of relay passages causes the refrigerant flowing from the plurality of outlets to flow out of the one inlet.

* * * * *